US005844184A

United States Patent [19]

Liau

[11] Patent Number: 5,844,184

[45] Date of Patent: Dec. 1, 1998

[54] SWITCH AND METHOD FOR MANUFACTURING THE SAME

[76] Inventor: Pen-Chu Liau, No. 1147, Sec. 1, Li-Ming Rd., Nan-Tun Dist., Taichung City, Taiwan

[21] Appl. No.: 902,653

[22] Filed: Jul. 30, 1997

[51] Int. Cl.[6] ..... H01H 15/00

[52] U.S. Cl. ..... 200/16 R; 200/16 D

[58] Field of Search ..... 29/622; 200/16 R–16 D, 200/537, 547, 549, 550, 252, 257, 291

[56] References Cited

U.S. PATENT DOCUMENTS

| | | | |
|---|---|---|---|
| 4,268,728 | 5/1981 | Rose | 200/16 R |
| 4,376,234 | 3/1983 | Liataud et al. | 200/16 R |
| 4,529,851 | 7/1985 | Priebe | 200/16 D |
| 4,926,012 | 5/1990 | Pellerin De Beauvais | 200/16 R |
| 5,043,540 | 8/1991 | Takano | 200/16 C |

*Primary Examiner*—Michael A. Friedhofer
*Attorney, Agent, or Firm*—Rodman & Rodman

[57] ABSTRACT

A switch includes an upper insulative body, left and right terminals mounted to the upper insulative body such that connecting end portions of the terminals extend outwardly from the upper insulative body, a lower insulative body attached to the upper insulative body, and a sliding actuator disposed between the upper and lower insulative bodies. The upper insulative body has an upper sliding slot to permit extension of the sliding actuator. The left and right terminals further have two contact end portions which extend inwardly of the upper insulative body and which are spaced in a longitudinal direction. The sliding actuator is provided with a spring electric contact member which has left and right contact fingers to contact the contact end portions of the terminals.

9 Claims, 8 Drawing Sheets

(I) PROVIDING LEFT AND RIGHT TERMINALS IN THE SAME PLANE AND SPACED FROM EACH OTHER IN A LONGITUDINAL DIRECTION (II) PLACING THE TERMINALS IN A MOLD (III) MOLDING AN UPPER INSULATIVE BODY (IV) PROVIDING A SLIDING ACTUATOR TO PROTRUDE OUT OF THE UPPER INSULATIVE BODY (V) PROVIDING A LOWER INSULATIVE BODY TO PERMIT SLIDING MOVEMENT OF THE SLIDING ACTUATOR (VI) ENGAGING THE LOWER INSULATIVE BODY WITH THE UPPER INSULATIVE BODY

FIG.3

SWITCH AND METHOD FOR MANUFACTURING THE SAME

BACKGROUND OF THE INVENTION

1. Field of the Invention

The invention relates to a switch, more particularly to a switch and method for manufacturing the same.

2. Description of the Related Art Referring to FIGS. 1 and 2, a conventional switch is shown to include an upper insulative body 13, a lower insulative body 11, a plurality of sliding actuators 12 (only one is shown), a plurality of spring electric contact members 123 (only one is shown), and a plurality of pairs of left and right terminals 112.

As illustrated, the upper insulative body 13 has a substantially flat top wall 131 formed with a plurality of sliding slots 131*a* therethrough, and left and right upright walls 13*a* which respectively extend downward from two opposite-sides of the top wall 131 to define a downwardly opening lower cavity 13*b* that is communicated with the sliding slots 131*a*.

Each of the sliding actuators 12 includes a sliding stem 121 which protrudes out of a respective one of the sliding slots 131*a* from the lower cavity 13*b* of the upper insulative body 13, and a sliding body 122 disposed at a bottom of the sliding stem 121. Each of the spring electric contact members 123 is mounted to the respective sliding body 12, and has left and right spring contact fingers 124 which extend downward relative to the respective sliding actuator 12.

The lower insulative body 11 includes left and right lateral end portions 11*a* and a slideway 111 disposed between the lateral end portions 11*a*.

The left and right terminals 112 are mounted to the lower insulative body 11 such that they are spaced apart from each other in alignment prior to attachment of the lower insulative body 11 to the upper insulative body 13. Each of the left and right terminals 112 has a contact end portion 112*a* disposed within a chamber defined by the lateral end portions 11*a* of the lower insulative body 11, a connecting end portion 112*b* exposed outwardly of the lower insulative body 11, and a middle portion 112*c* embedded at junctions of the left or right end portion 11*a* and a bottom of the insulative body 11. After assembly, the left and right spring contact fingers 124 are capable of establishing connection between the contact end portions 112*a* of the left and right terminals 112 when the sliding stem 121 is moved in the sliding slot 131*a* from a switch-off position to a switch-on position.

A disadvantage of the conventional switch resides in that dust can fall through the sliding slots 131*a* in the top wall 131*a* of the upper insulative body 13 and can accumulate between surfaces of the spring contact fingers 124 and the contact end portions 112*a* of the terminals 112, thereby hindering electrical flow.

SUMMARY OF THE INVENTION

The object of this invention is to provide a switch which is clear of the above-mentioned drawback and a method for manufacturing the same.

According to this invention, the method for manufacturing a switch comprises the steps of:

providing a pair of left and right terminals substantially in the same plane and spaced apart from each other in a longitudinal direction, each of the left and right terminals including a contact end portion proximate to each other, a connecting end portion opposite to the contact end portion, and a middle portion between the contact and connecting end portions;

placing the left and right terminals in a mold for molding an upper insulative body which includes a top wall and left and right upright walls respectively extending downward from two opposite sides of the top wall so as to define a downwardly opening lower cavity, the middle portions of the left and right terminals being embedded in junctions between the top wall and the left and right upright walls respectively so as to dispose each of the connecting end portions outwardly of the left and right upright walls and so as to dispose each of the contact end portions inwardly of the left and right upright walls of the upper insulative body, the contact end portions being exposed from the cavity, the top wall having a sliding slot communicated with the cavity and defined by first and second inner lateral walls which extend downwardly past the contact end portions respectively so as to form left and right suspended abutment portions, respectively;

providing a sliding actuator, the sliding actuator including a sliding stem of a first dimension to be able to protrude out of the sliding slot from the cavity and movable between the first and second inner lateral walls;

a sliding body disposed at a bottom of the sliding stem and having a second dimension such that the sliding body can be kept in sliding contact with the left and right suspended abutment portions during movement of the sliding stem in the sliding slot; and a spring electric contact member mounted on the sliding body and having left and right spring contact fingers that extend respectively upward from the sliding body and beyond the top surface of the sliding body so as to be able to contact the contact end portions of the left and right terminals, respectively;

providing a lower insulative body, the lower insulative body including left and right lateral end portions respectively engageable with the left and right upright walls, and a slideway disposed between the left and right lateral end portions to define a chamber with the cavity for receiving the sliding body such that the sliding body is slidable from a switch-off position to a switch-on position; and engaging the lateral end portions of the lower insulative body with the upright walls of the upper insulative body once the sliding stem of the sliding actuator is held to protrude out of the sliding slot from the cavity so that the slideway will provide a slidable support to the sliding body, thereby permitting contact among the contact fingers and the contact end portions.

BRIEF DESCRIPTION OF THE DRAWINGS

Other features and advantages of this invention will become apparent in the following detailed description of the preferred embodiment of this invention, with reference to the accompanying drawings, in which:

FIG. 3 is a block diagram illustrating the steps for manufacturing a switch according to this invention;

DETAILED DESCRIPTION OF THE PREFERRED EMBODIMENT

Figure 7:
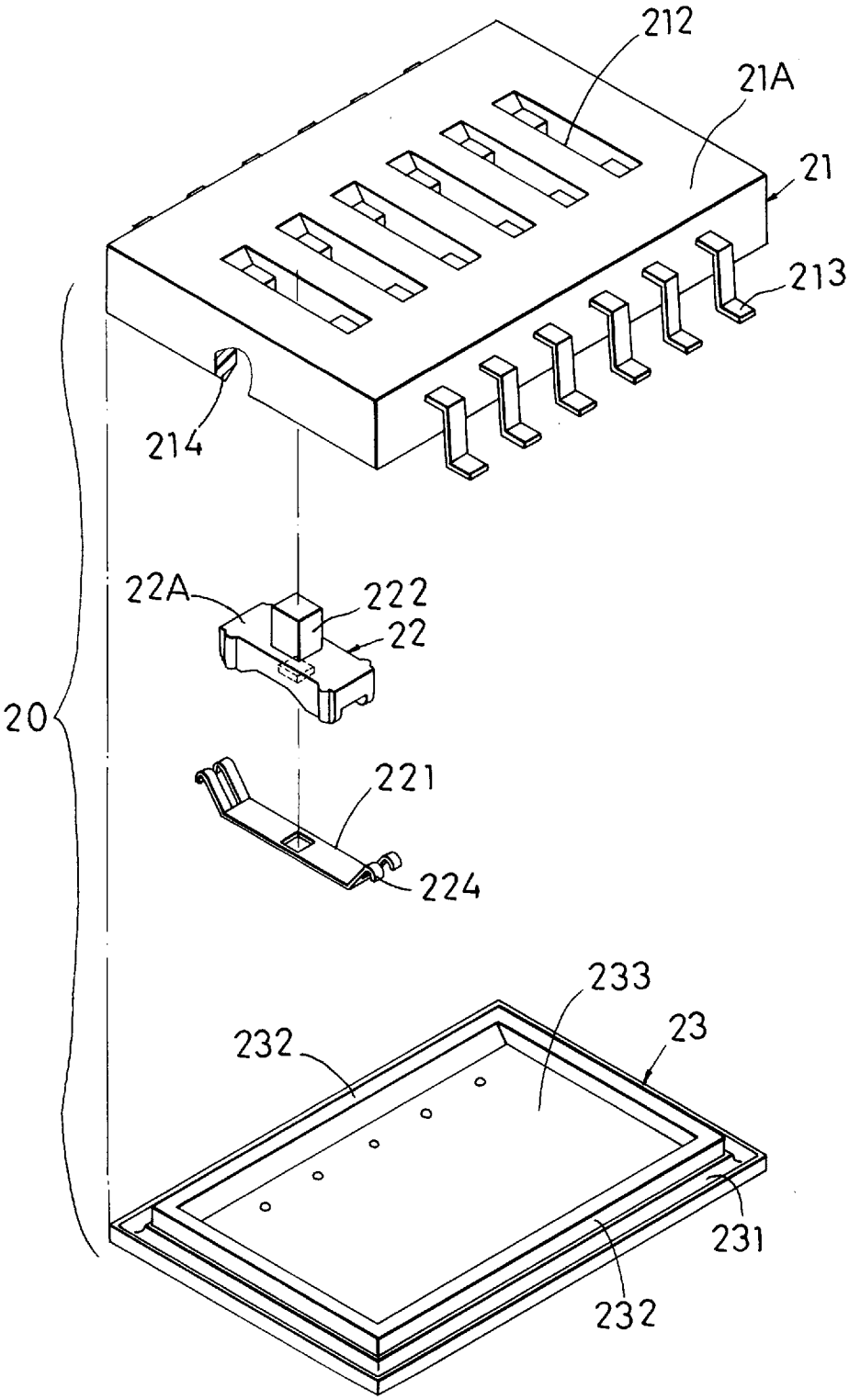
FIG. 7 illustrates the sixth step for manufacturing the switch of this invention.
Figure 8:
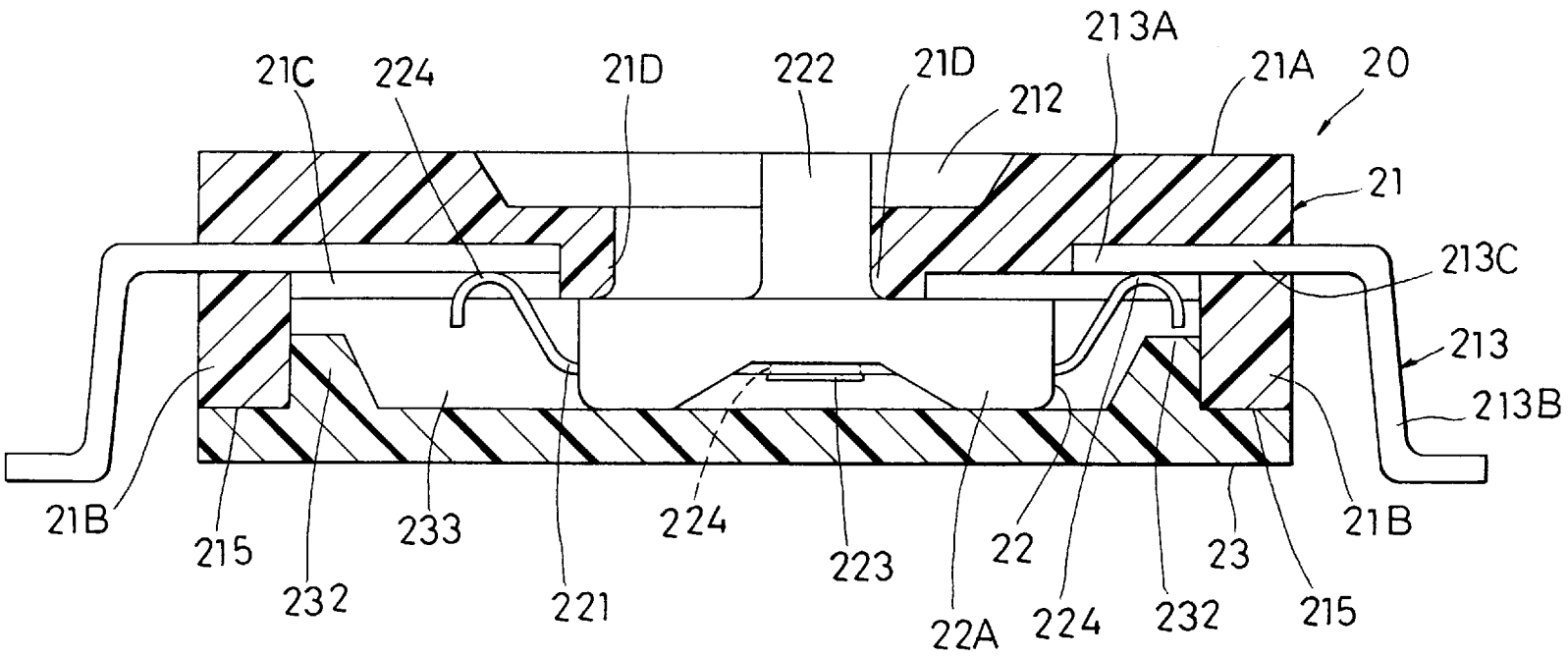
FIG. 8 is a sectional view of the switch manufactured according to this invention.

Referring to FIGS. 7 and 8, the preferred embodiment of a switch 20 of this invention includes an upper insulative body 21, a plurality of pairs of left and right terminals 213, a plurality of insulative sliding actuators 22 (only one pair is shown), a plurality of spring electric contact members 221 (only one is shown), and a lower insulative body 23.

As illustrated, the upper insulative body 21 includes a substantially flat top wall 21A formed with a plurality of sliding slots 212 therethrough, and left and right upright walls 21B which respectively extend downward from two opposite sides of the top wall 21A to define a downwardly opening cavity 21C. The top wall 21A of the upper insulative body 21 further has first and second inner lateral walls 21D which are spaced from each other in a longitudinal direction to define the sliding slot 212 that is communicated with the cavity 21C.

The left and right terminals 213 are attached to the upper insulative body 21 in the same plane such that the left and right terminals 213 in the respective pair are spaced apart from each other in the longitudinal direction. Each of the left and right terminals 213 has a middle portion 213C embedded in a junction between one of the left and right upright walls 21B and the top wall 21A, a contact end portion 213A which extends from the middle portion 213C into the cavity 21C of the upper insulative body 20, and a connecting end portion 213B which extends outwardly and downwardly from one of the left and right upright walls 21B of the upper insulative body 21.

Each of the sliding actuators 22 includes a sliding stem 222, of a first dimension, which protrudes out of one of the sliding slots 212 and which is movable between the left and right inner lateral walls 21B, and a sliding body 22A disposed at a bottom of the sliding stem 222 and movable within the cavity 21C in the longitudinal direction.

Each of the spring electric contact members 221 is mounted to the respective sliding body 22A and includes left and right spring contact fingers 224 which extend upward from the sliding body 22A beyond a top surface of the latter for contacting the contact end portions 213A of the left and right terminals 213 respectively.

The lower insulative body 23 includes left and right lateral end portions 232 engaging securely and respectively the left and right upright walls 21B of the upper insulative body 21, and a slideway 233 disposed between the left and right lateral end portions 232 to define a chamber with the cavity 21C for receiving the sliding body 22A such that the latter is slidable from a switch-off position to a switch-on position when the sliding stem 222 is shifted in the sliding slot 212.

In the preferred embodiment, the left and right inner lateral walls 21D of the top wall 21A extend downwardly past the contact end portions 213A of the left and right terminals 213 respectively so as to form left and right suspended abutment portions. The sliding body 22A is dimensioned such that the sliding body 22A is kept in sliding contact with the left and right suspended abutment portions so as to provide stability during movement of the sliding stem 222 in the sliding slot 212.

Figure 1:
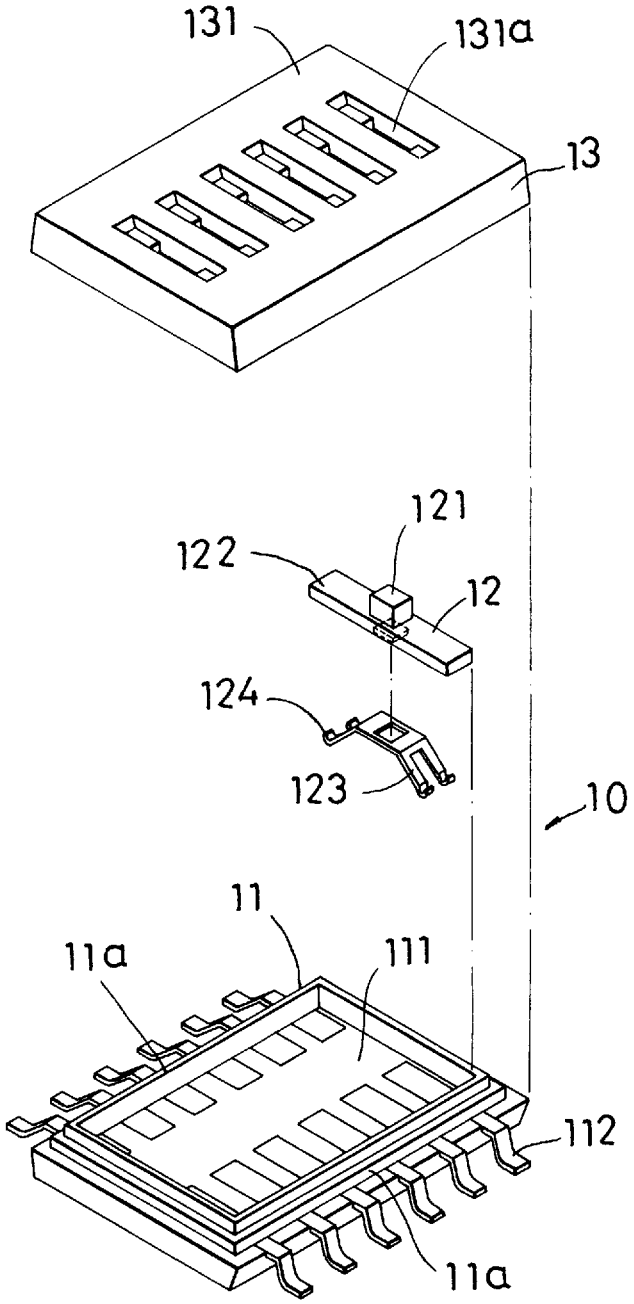
FIG. 1 PRIOR ART
FIG. 1 is an exploded view of a conventional switch.
Figure 2:
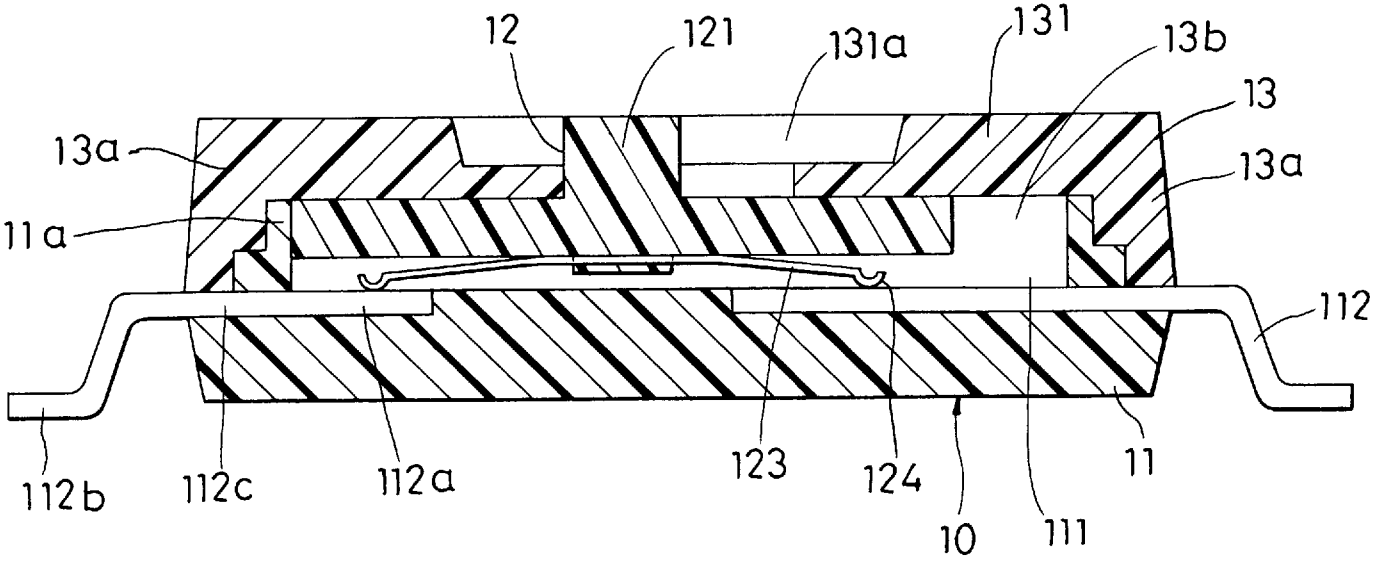
FIG. 2 PRIOR ART
FIG. 2 is a sectional view of the conventional switch.
Figure 4:
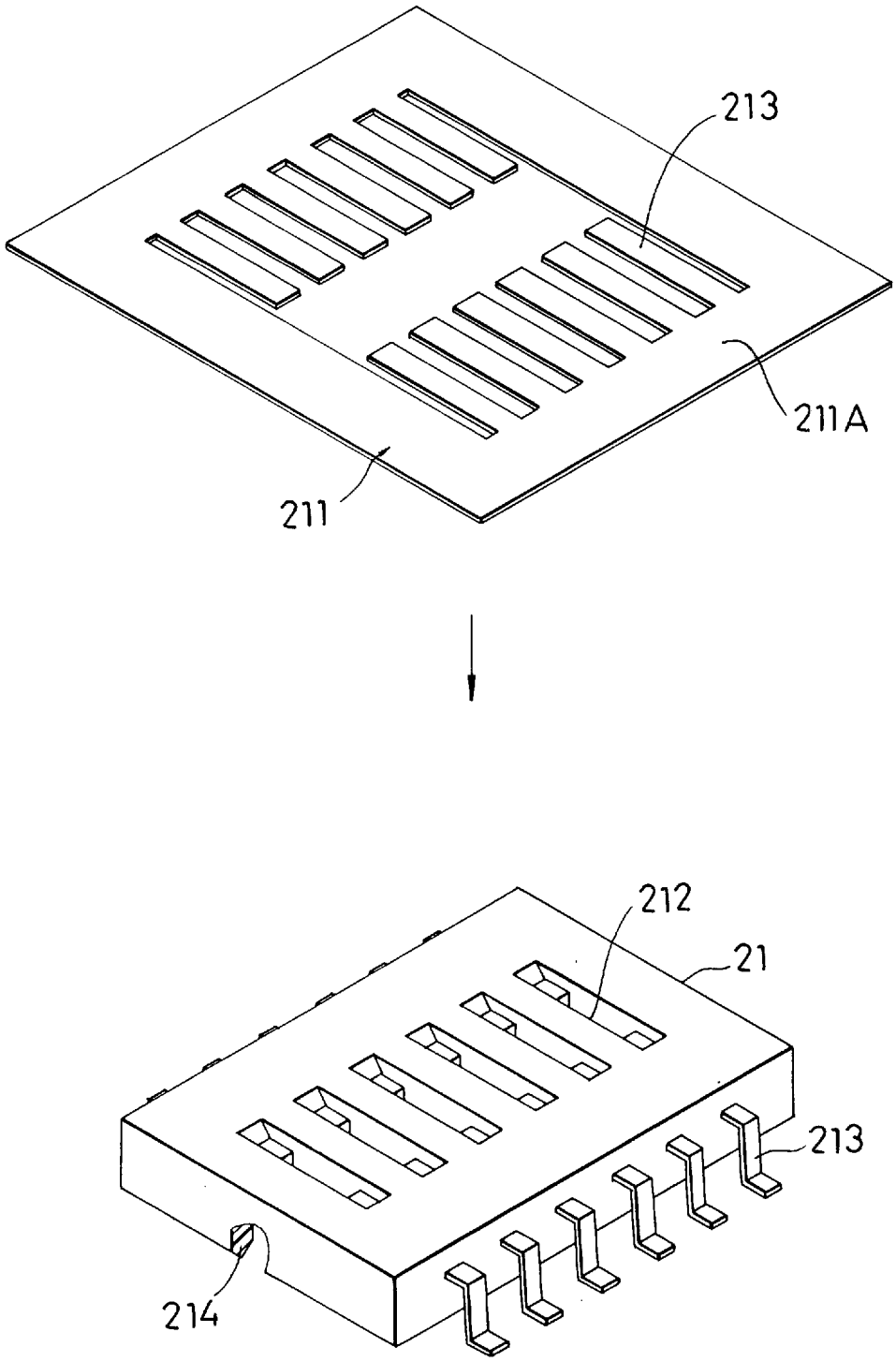
FIG. 4 illustrates the first, second and third steps for manufacturing the switch of this invention.

The preferred embodiment as shown in FIG. 3 of a method for manufacturing a switch according to this invention comprises the following steps:

(i) Referring to FIGS. 4 and 8, a metal sheet 211 is punched to include therein a plurality of pairs of left and right terminals 213 parallel to adjacent ones of the terminal pairs so as to form an array. The metal sheet 211 has a peripheral portion 211A which interconnects the connecting end portions 213A of the left and right terminals 213. Each of the terminals 213 includes a contact end portion 213A, a connecting end portion 213B and a middle portion 213C between the contact and connecting end portions 213A, 213B.

(ii) The left and right terminals 213 are placed in a mold such that the former are spaced from each other in a longitudinal direction.

(iii) An upper insulative body 21 is molded and includes a top wall 21A and left and right upright walls 21B which respectively extend downward from two opposite sides of the top wall 21A so as to define a downwardly opening cavity 21C. The upper insulative body 21 further includes a plurality of sliding slots 212 formed through the top wall 21A thereof and communicated with the cavity 21C, and left and right inner lateral walls 21D which are spaced from each other in the longitudinal direction and which extend downward to form left and right suspended abutment portions. After molding, the peripheral portion 211A of the metal sheet 211 is trimmed to separate the left and right terminals 213 from each other. Thus, the middle portions 213C of the left and right terminals 213 are embedded at the junctions between the top wall 21A and the left and right upright walls 21B. The contact end portions 213A of the left and right terminals 213 extend from the middle portions 213C into the cavity 21C of the upper insulative body 21 while the connecting end portions 213B thereof extend outwardly and downwardly from the left and right upright walls 21B of the upper insulative body 21.

Figure 5:
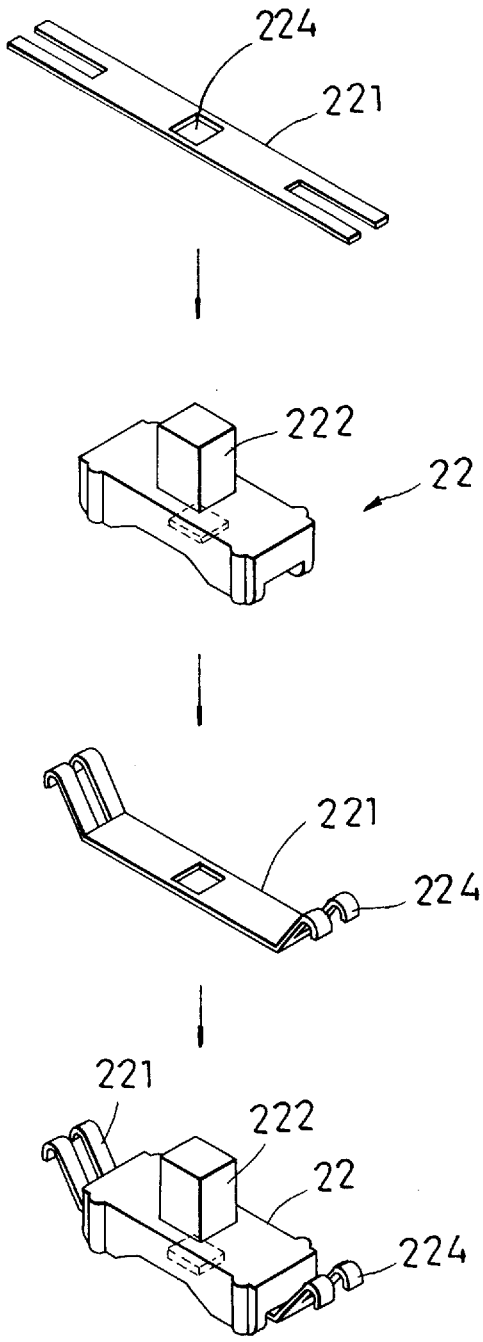
FIG. 5 illustrates the fourth step for manufacturing the switch of this invention.

(iv) Referring to FIG. 5 and 8, the insulative sliding actuator 22 is formed to include a sliding stem 222, of a first dimension, which protrudes out of the sliding slot 212 from the cavity 21C and which is movable between the left and right inner lateral walls 21D, and a sliding body 22A which is disposed at a bottom of the sliding stem 222 and which is sized so as to keep in sliding contact with the left and right suspended abutment portions during movement of the sliding stem 222 in the sliding slot 212 in order to provide stability. A spring electric contact member 221 is mounted to the sliding body 22A and includes left and right spring contact fingers 224 which extend respectively upward from the sliding body 22A and beyond the top surface of the sliding body 22A for contacting the contact end portions 213A of the left and right terminals 213, respectively.

Figure 6:
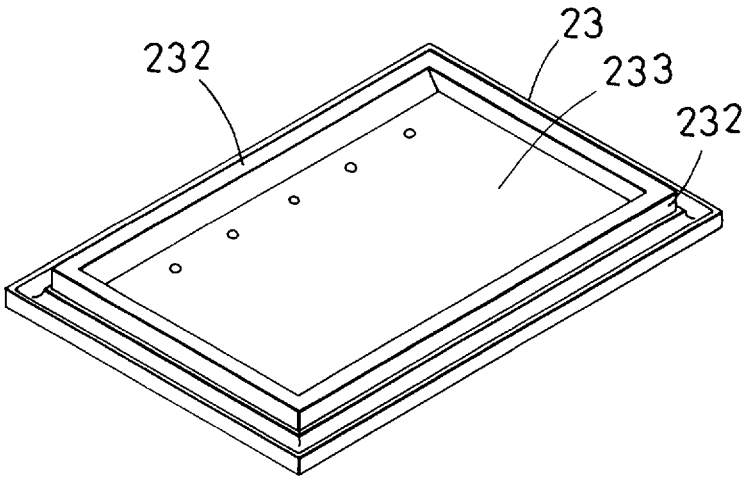
FIG. 6 illustrates the fifth step for manufacturing the switch of this invention.

(v) Referring to FIGS. 6 and 8, a lower insulative body 23 is molded to include left and right lateral end portions 232 respectively engageable with the left and right upright walls 21B of the upper insulative body 21, and a slideway 233 disposed between the left and right lateral end portions 232 to define a chamber with the cavity 21C for receiving the sliding body 22A such that the latter is slidable from a switch-off position to a switch-on position.

(vi) As best shown in FIG. 8, the lateral end portions 232 of the lower insulative body 23 can be engaged with the left and right upright walls 21B of the upper insulative body 21 once the sliding stem 222 of the sliding actuator is held to protrude out of the sliding slot 212 from the cavity 21C. The slideway 233 of the lower insulative body 23, in combination with the sliding slot 212 of the upper insulative body 21, will provide a slidable support to the sliding body 22A.

In the preferred embodiment, either the upper or lower insulative body 21, 23 is provided with protrusions 214 (see FIG. 7) which are electrically melted so as to form a hermetic seal 215 between the insulative bodies 21, 23. Note that the insulative bodies 21, 23 can also be connected relative to each other by conventional groove-and-projection means, a detailed description of which is omitted herein. The protrusions and the groove-and-projection means serve as engagement units.

The switch manufactured according to this invention provides good electrical connection because dust can not accumulate between surfaces of the terminals 213 and the contact fingers 224 of the spring electric contact member 221.

With this invention thus explained, it is apparent that numerous modifications and variations can be made without departing from the scope and spirit of this invention. It is therefore intended that this invention be limited only as indicated in the appended claims.

I claim:

1. A method for manufacturing a switch, comprising the steps of:

(i) providing a pair of left and right terminals substantially in the same plane and spaced apart from each other in a longitudinal direction, each of said left and right terminals including a contact end portion proximate to each other, a connecting end portion opposite to said contact end portion, and a middle portion between said contact and connecting end portions;

(ii) placing said left and right terminals in a mold for molding an upper insulative body which includes a top wall and left and right upright walls respectively extending downward from two opposite sides of said top wall so as to define a downwardly opening cavity;

(iii) molding said upper insulative body so as to embed said middle portions of said left and right terminals in junctions between said top wall and said left and right upright walls respectively so as to dispose each of said connecting end portions outwardly of said left and right upright walls and so as to dispose each of said contact end portions inwardly of said left and right upright walls respectively, said contact end portions being exposed from said cavity, said top wall further having a sliding slot communicated with said cavity and defined by first and second inner lateral walls which extend downward past said contact end portions respectively so as to form left and right suspending abutment portions respectively, (iv) providing a sliding actuator which includes a sliding stem of a first dimension to be able to protrude out of said sliding slot from said cavity and movable between said first and second inner lateral walls;

a sliding body disposed at a bottom of said sliding stem and having a second dimension such that said sliding body can be kept in sliding contact with said left and right suspending abutment portions during said movement of said sliding stem in said sliding slot; and a spring electric contact member mounted on said sliding body and having left and right contact fingers that extend respectively upward from said sliding body and beyond a top surface of said sliding body so as to be able to contact said contact end portions of said left and right terminals, respectively;

(v) providing a lower insulative body which includes left and right lateral end portions respectively engageable with said left and right upright walls, and a slideway disposed between said left and right lateral end portions to define a chamber with said cavity for receiving said sliding body such that said sliding body is slidable from a switch-off position to a switch-on position; and (vi) engaging said lateral end portions of said lower insulative body with said upright walls of said upper insulative body once said sliding stem of said sliding actuator is held to protrude out of said sliding slot from said cavity so that said slideway will provide a slidable support to said sliding body, thereby permitting contact among said contact fingers and said contact end portions.

2. A method for manufacturing a switch as defined in claim 1, wherein in step (i), a plurality of pairs of said left and right terminals are provided and are oriented in a parallel array.

3. A method for manufacturing a switch as defined in claim 2, prior to step (i), further comprising a step of punching a metal sheet to form therein said plurality of pairs of said left and right terminals with each of said pairs being parallel to an adjacent one of said pairs to form said parallel array, and with a peripheral portion to interconnect said connecting end portions of said left and right terminals.

4. A method for manufacturing a switch as defined in claim 3, subsequent to said molding step (iii), further comprising a step of trimming said peripheral portion to separate said connecting end portions from each other.

5. A method for manufacturing a switch as defined in claim 1, further comprising a step of sealing the respective engagements between said left and right lateral end portions and said left and right upright walls.

6. A switch comprising:

an upper insulative body including a top wall formed with a sliding slot therethrough which is defined by first and second inner lateral walls that are spaced apart from each other in a longitudinal direction, and left and right upright walls respectively extending downward from two opposite sides of said top wall so as to define a downwardly opening cavity that is communicated with said sliding slot;

a pair of left and right terminals spaced from each other in said longitudinal direction, each of said terminals has a middle portion embedded in a junction between said top wall and each of said left and right upright walls, a contact end portion extending from said middle portion into said cavity of said upper insulative body, and a connecting end portion extending from said middle portion and outwardly of said left and right upright walls;

a sliding actuator including:

a sliding stem protruding out of said sliding slot and slidable between said first and second inner lateral walls, a sliding body disposed at a bottom of said sliding stem and movable within said cavity in said longitudinal direction, and a spring electric contact member mounted on said sliding body and including left and right spring contact fingers that extend respectively upward from said sliding body and beyond a top surface of said sliding body to contact said contact end portions of said left and right terminals, respectively; and a lower insulative body including:

left and right lateral end portions respectively engaged with said left and right upright walls of said upper insulative body, and a slideway disposed between said left and right lateral end portions and defining a chamber with said cavity to receive said sliding body such that said sliding body is slidable along said longitudinal direction from a switching-off position to a switch-on position when said sliding stem is shifted.

7. The switch as defined in claim 6, wherein said first and second inner lateral walls extend downwardly past said contact end portions of said left and right terminals respectively so as to form left and right suspended abutment portions respectively, said sliding body having a second dimension such that said sliding body can be kept in sliding contact with said left and right suspended abutment portions during movement of said sliding stem in said sliding slot.

8. The switch as defined in claim 6, wherein said switch comprises a plurality of pairs of said left and right terminals attached to said upper insulative body and oriented in said longitudinal direction so as to form a parallel array.

9. The switch as defined in claim 6, wherein said upper and lower insulative bodies are connected to each other in such a manner that a hermetic seal is formed therebetween.

* * * * *